US010548458B1

(12) United States Patent
Sankey

(10) Patent No.: US 10,548,458 B1
(45) Date of Patent: Feb. 4, 2020

(54) TETHERED CLEANING TOOL FOR A KITCHEN SINK

(71) Applicant: Jeremy Joseph Sankey, Richardson, TX (US)

(72) Inventor: Jeremy Joseph Sankey, Richardson, TX (US)

( * ) Notice: Subject to any disclaimer, the term of this patent is extended or adjusted under 35 U.S.C. 154(b) by 149 days.

(21) Appl. No.: 15/186,039

(22) Filed: Jun. 17, 2016

Related U.S. Application Data

(60) Provisional application No. 62/263,023, filed on Dec. 4, 2015.

(51) Int. Cl.

| | |
|---|---|
| ***A47L 17/00*** | (2006.01) |
| ***A46B 17/00*** | (2006.01) |
| ***A47L 13/16*** | (2006.01) |
| ***A47L 17/04*** | (2006.01) |
| ***A47L 13/42*** | (2006.01) |

(52) U.S. Cl.
CPC ..... *A47L 17/00* (2013.01); *A46B 17/00* (2013.01); *A47L 13/16* (2013.01); *A47L 13/42* (2013.01); *A47L 17/04* (2013.01); *A47K 2201/00* (2013.01)

(58) Field of Classification Search
CPC ..... A47L 13/10; A47L 13/16; A47L 13/42; A47L 17/04; A47L 17/06; A47L 17/08; A61B 90/80
USPC ..... 15/159.1, 160, 209.1, 210.1, 229.11, 15/224.1, 224.4, 246; 4/628, 654; 248/693, 683, 306, 689, 690, 317, 320, 248/327, 328
See application file for complete search history.

(56) References Cited

U.S. PATENT DOCUMENTS

| | | | | |
|---|---|---|---|---|
| 828,258 | A * | 8/1906 | Wach | A45F 3/00 248/693 |
| 847,279 | A * | 3/1907 | Cox | F16M 13/00 248/317 |
| 2,253,269 | A * | 8/1941 | Gaddis | G01F 23/045 15/220.4 |
| 6,205,623 | B1 * | 3/2001 | Shepard | A44B 18/0049 24/30.5 R |
| 6,349,443 | B1 * | 2/2002 | Randolph | A46B 9/02 15/106 |
| 6,612,530 | B1 * | 9/2003 | Kwak | A47K 5/04 211/113 |
| 2006/0123572 | A1 * | 6/2006 | Faiola | A46B 11/0006 15/104.92 |

* cited by examiner

*Primary Examiner* — Joseph J Hail
*Assistant Examiner* — Abbie E Quann

(57) ABSTRACT

A tethered cleaning tool includes an elongated, helical cord having two opposing ends. A first end of the cord is fastened to a magnetic attachment sleeve for tethering the cord to a faucet riser or similar support surface. At the opposing, second end of the cord is a quick-connect fitting for securing the cord to any one of a plurality of interchangeable cleaning implements, such as a sponge or a brush. Accordingly, a desired cleaning implement is conveniently suspended above a sink until needed.

3 Claims, 2 Drawing Sheets

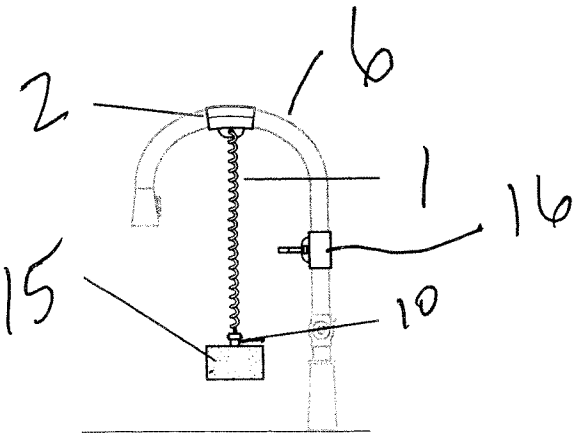
Fig. 1
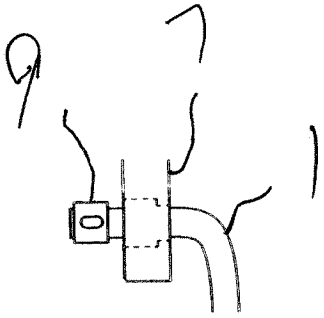
Fig. 2
Fig. 3
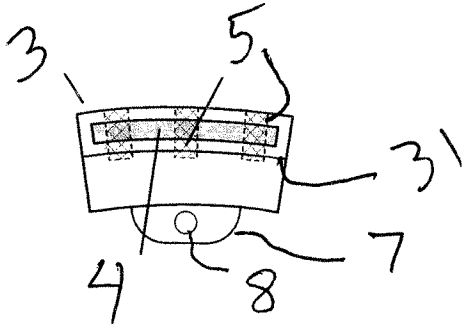
Fig. 4

TETHERED CLEANING TOOL FOR A KITCHEN SINK

CROSS REFERENCE TO RELATED APPLICATIONS

This application is entitled to the benefit of provisional patent application No. 62/263,023 filed on Dec. 4, 2015, the specification of which is incorporated herein by reference.

BACKGROUND OF THE INVENTION

The present invention relates to a cleaning implement, such as a sponge, a brush or a pad, that is conveniently tethered to and suspended from a sink faucet.

DESCRIPTION OF THE PRIOR ART

Dirty dishes are often piled into a sink where they are soaked in soapy water prior to cleaning. However, locating a suitable cleaning implement, such as a sponge or brush, is always challenging. Often, the cleaning implement is submerged in the dish water, requiring the user to blindly search for the implement with a hand. If the water is turbid due to significant food residue and debris, quickly locating the implement can be difficult and the user's hands become soiled.

Furthermore, if not submerged, the cleaning implement is often resting on a sink ledge or a countertop, where it is continuously exposed to standing water, thereby creating an ideal environment for bacterial growth. Various baskets and similar retainers purportedly address this problem but they occupy valuable sink space and also harbor bacteria unless cleaned routinely.

Accordingly, there is currently a need for a cleaning implement that is conveniently retained near a kitchen sink until needed. The present invention addresses this need by providing a helical, expandible cord attached to a sink faucet that is securable to any one of multiple, interchangeable cleaning implements. Therefore, the cleaning implement is conveniently suspended near the sink where it is easily accessible and away from any accumulated moisture. The tethered cleaning implement is readily available when cleaning dishes or sinks, eliminating the burdensome task of locating and handling a submerged or saturated implement.

SUMMARY OF THE INVENTION

The present invention relates to a tethered cleaning tool comprising an elongated, helical cord having two opposing ends. A first end of the cord is fastened to a magnetic attachment sleeve for tethering the cord to a faucet riser or similar support surface. At the opposing, second end of the cord is a quick-connect fitting for securing the cord to any one of a plurality of interchangeable cleaning implements, such as a sponge or a brush. A second sleeve that is structurally identical to the first sleeve is secured to an intermediate, vertical portion of the faucet riser, or to a similar convenient location. Horizontally extending from the second sleeve is a hook that retains the cleaning implement away from the sink when the user is performing certain tasks or when the device is not in use. Accordingly, a desired cleaning implement is conveniently suspended above a sink until needed.

It is therefore an object of the present invention to provide a cleaning implement that is conveniently tethered to a sink faucet.

It is therefore another object of the present invention to provide a device that conveniently retains a cleaning implement near a kitchen sink.

Other objects, features, and advantages of the present invention will become readily apparent from the following detailed description of the preferred embodiment when considered with the attached drawings and the appended claims.

BRIEF DESCRIPTION OF THE DRAWINGS

FIG. 1 is a side, plan view of a kitchen faucet with the cleaning implement tethered thereto.

FIG. 2 is an isolated view of the cord and attachment flange.

FIG. 3 is an end view of the first sleeve.

FIG. 4 is a side view of the first sleeve.

DESCRIPTION OF THE PREFERRED EMBODIMENT

Figure 6:
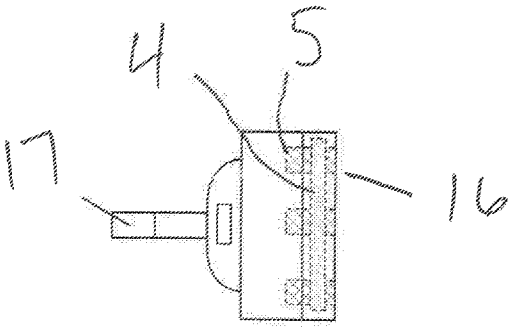
FIG. 6 is a side view of the second sleeve.
Figure 9:
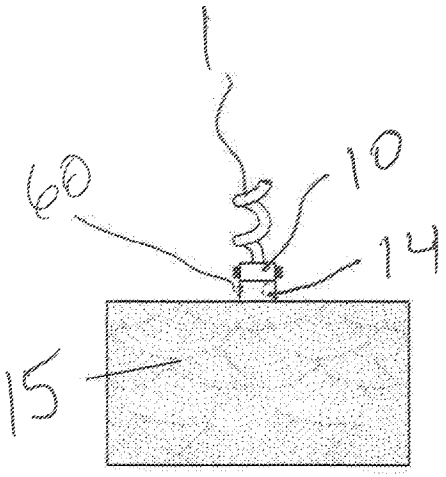
FIG. 9 depicts an exemplary cleaning implement with the cord secured thereto.
Figure 5:
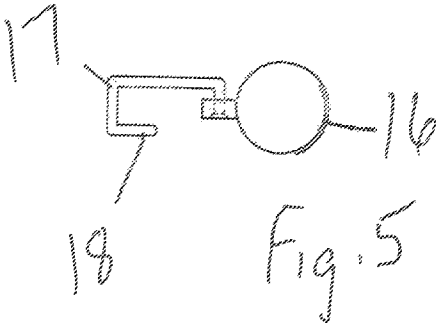
FIG. 5 is a top view of the second sleeve.
Figure 8:
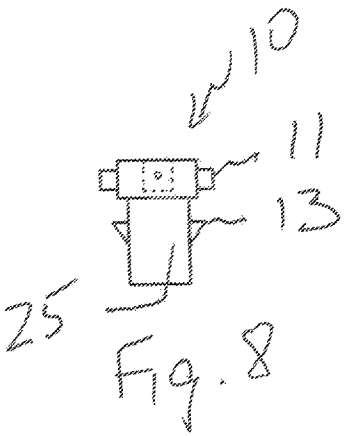
FIG. 8 is a side view of the quick-connect cylinder.
Figure 7:
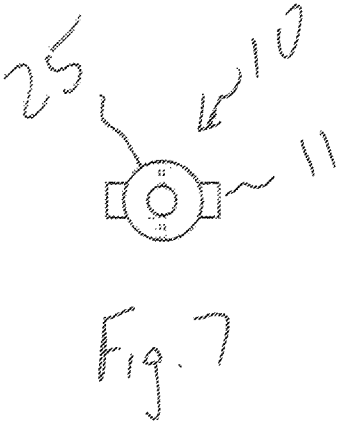
FIG. 7 is a top view of the quick-connect cylinder.

The present invention relates to a cleaning tool tethered to a sink faucet comprising an elongated, helical cord 1 having two opposing ends. The cord is constructed with a resilient but elastomeric material allowing it to freely expand and contract. A first end of the cord is fastened to an attachment mechanism 2 that tethers the cord to a faucet riser 6 or similar support surface. The attachment mechanism 2 includes a separable sleeve 3 having two mating overlapping free edges 31. Adjacent to a first edge is an elongated, magnetic strip 4 that adheres to a plurality of ferromagnetic, wire-mesh patches 5 adjacent to the other edge for releasably securing the sleeve around the support surface. Depending from an outer surface of the sleeve is a flange 7 having an aperture 8 thereon. The first end of the cord is inserted through the aperture and secured therein with a crimped fastener 9.

At the opposing, second end of the cord is a quick-connect fitting 10 for securing the cord to any one of a plurality of interchangeable cleaning implements 15. The quick-connect fitting includes a cylinder 25 having a pair of diametrically opposed, spring-biased buttons 11 extending therefrom that retract and release gripping teeth 13 in a conventional fashion. The teeth seat within mating receptacles 60 in a receiver 14 imbedded in each cleaning implement to fasten the cord thereto. When depressed, the buttons retract the teeth 13 from the receptacles to allow a user to detach or replace the cleaning implement.

A second sleeve 16 that is structurally identical to the first sleeve is secured to an intermediate, vertical portion of the faucet riser, or to a similar convenient location. Horizontally extending from the second sleeve is a C-shaped hook 17 having a retainer 18 extending inwardly from one of two ends. The hook allows a user to position the cleaning implement closer to the faucet and away from the sink when performing certain tasks or when the device is not in use.

The cleaning implements 15 include at least a sponge, a brush having an integral soap reservoir and a combination scrubbing brush and sponge. Each implement includes the mating receiver partially imbedded in an outer wall for mating with the quick-connect fitting. Accordingly, a desired cleaning implement is conveniently tethered near a sink until needed while being suspended above any damp surfaces to minimize bacterial accumulation.

The above-described device is not limited to the exact details of construction and enumeration of parts provided herein. For example, preferably the device includes a means for adjusting the cord's length to accommodate varying-size sink hardware. Therefore, the device may include a guide and tools for trimming the cord and reattaching it to the quick-connect fitting, if desired. Furthermore, the flange may include multiple apertures for securing a plurality of cords to a single faucet to simultaneously suspend a sponge, a brush and/or multiple other items. Finally, a small, digital clock or a touch-screen display could be attached to the first sleeve. The display would include WiFi and Bluetooth capabilities to allow a user to freely access the internet. Furthermore, the size, shape and materials of construction of all of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed:

1. An assembly comprising:

a) a sink faucet comprising a faucet riser; and b) a cleaning tool tethered to the faucet riser, wherein the cleaning tool comprises:

1) an elongated helical cord having a first end and a second end;

2) means for removably attaching the first end of said helical cord to said faucet riser;

3) a cleaning implement; and 4) means for removably attaching the cleaning implement to the second end of said cord to suspend said cleaning implement from said faucet riser, wherein said means for removably attaching the first end of said cord to said faucet riser comprises:

a first separable sleeve having two overlapping free edges;

an elongated, magnetic strip adjacent to a first of said two overlapping edges;

a plurality of wire-mesh patches adjacent to a second of said overlapping edges that releasably adhere to said magnetic strip for securing the first separable sleeve around the faucet riser, wherein said means for removably attaching the cleaning implement to the second end of said helical cord comprises:

a cylinder at the second end of said helical cord;

a pair of teeth extending from said cylinder;

a pair of buttons extending from said cylinder and operably connected to said pair of teeth;

a receiver attached to said cleaning implement, said receiver having a pair of receptacles receiving said teeth whereby when said buttons are depressed, the buttons retract said teeth to release said cleaning implement.

2. The assembly according to claim 1 further comprising a means for securing an intermediate portion of said helical cord to said faucet riser to retain said cleaning implement away from an underlying sink.

3. The assembly according to claim 2 wherein said means for securing the intermediate portion of said helical cord to said faucet riser to retain said cleaning implement away from an underlying sink comprises:

a second separable sleeve having two overlapping free edges;

an elongated, magnetic strip adjacent to a first of said two overlapping edges of the second separable sleeve; a plurality of wire-mesh patches adjacent to a second of said overlapping edges of the second separable sleeve that releasably adhere to said magnetic strip for securing the second separable sleeve around the faucet riser;

a C-shaped hook horizontally extending from the second separable sleeve, said C-shaped hook having a retainer extending inwardly from one of two ends for gripping the intermediate portion of said helical cord.

* * * * *